US005722265A

United States Patent [19]

Cho

[11] Patent Number: 5,722,265

[45] Date of Patent: Mar. 3, 1998

[54] WASHING MACHINE EQUIPPED WITH A LAUNDRY-STRIKING APPARATUS

[75] Inventor: In-Su Cho, Kwangju, Rep. of Korea

[73] Assignee: Daewoo Electronics Co., Ltd., Seoul, Rep. of Korea

[21] Appl. No.: 772,750

[22] Filed: Dec. 23, 1996

[30] Foreign Application Priority Data

Dec. 28, 1995 [KR] Rep. of Korea ..... 95-50773

[51] Int. Cl.[6] ..... D06F 17/08; D06F 17/10

[52] U.S. Cl. ..... 68/133; 68/134

[58] Field of Search ..... 68/133, 134

[56] References Cited

U.S. PATENT DOCUMENTS

| | | | |
|---|---|---|---|
| 5,176,012 | 1/1993 | Oh et al. | 68/134 X |
| 5,421,174 | 6/1995 | Kim et al. | 68/134 X |
| 5,596,891 | 1/1997 | Bae et al. | 68/134 X |

FOREIGN PATENT DOCUMENTS

| | | | |
|---|---|---|---|
| 113667 | 8/1941 | Australia | 68/133 |
| 2142937 | 1/1985 | United Kingdom . | |

*Primary Examiner*—Philip R. Coe

*Attorney, Agent, or Firm*—Beveridge, DeGrandi, Weilacher & Young LLP

[57] ABSTRACT

A washing machine is disclosed which applies direct impulses to laundry. The washing machine includes a cam, a plurality of horizontal movement parts, and a plurality of vertical movement parts. The cam is fixedly inserted into the shaft of the speed-reducing gear assembly between the pulsator and the speed-reducing gear assembly, and rotated according to the rotation of the shaft. The cam has the outer circumference on which concavities and convexities are alternately formed. The plurality of horizontal movement parts are slidably contacted with the outer circumference to thereby be reciprocated in the left and right directions according to the concavities and the convexities. The plurality of vertical movement parts are connected to the plurality of horizontal movement parts respectively. Each of the plurality of vertical movement parts moves up and down in the vertical direction according to the left and right reciprocal movements of each of the plurality of horizontal movement parts.

6 Claims, 5 Drawing Sheets

WASHING MACHINE EQUIPPED WITH A LAUNDRY-STRIKING APPARATUS

BACKGROUND OF THE INVENTION

1. Field of the Invention

The present invention relates to a washing machine, more particularly to a washing machine equipped with a laundry-striking apparatus.

2. Prior Art

In general, commercial washing machines are classified into a pulsator-type washing machine, a drum-type washing machine, and an agitator-type washing machine by a washing manner.

The pulsator-type washing machine has a pulsator rotatably mounted on the bottom of the washing tub therein. When the pulsator is rotated, the washing water in the washing tub is also rotated. The rotation of the washing water causes a whirlpool-type waterflow in the washing water. The pulsator-type washing machine rotates laundry together with the washing water and is most widely used.

The drum-type washing machine has a cylindrical drum having a plurality of holes thereon. The cylindrical drum is rotatably mounted in the reservoir. A plurality of protrusions are formed on the inside of the cylindrical drum. When the cylindrical drum is rotated, the laundry is lifted up by means of the plurality of protrusions. The laundry which has been lifted up falls down by means of gravity. Since the laundry being lifted up and falling down, the laundry is washed. The drum-type washing machine is suitable for a greater amount of laundry to be washed at one time.

An agitator-type washing machine has an agitator rotatably mounted on the center portion of the washing machine. A plurality of wings are formed on the periphery of the agitator. When the agitator is rotated, the plurality of wings agitate washing water in the washing tub. The agitation of the washing water causes a certain waterflow to be formed in the washing water. The waterflow agitates the laundry in the washing water. The agitated laundry strikes the agitator and the wall of the washing tub. The striking enables the agitated laundry to be washed.

FIG. 1 is a view for schematically showing a conventional pulsator-type washing machine, and FIG. 2 is a view for schematically showing the washing tub of FIG. 1. As shown in FIGS. 1 and 2, the conventional pulsator-type washing machine includes a reservoir 1, a washing tub 2, and a pulsator 3. The reservoir 1 is a container which accommodates washing water. The washing tub 2 is mounted in the reservoir 1. The pulsator 3 is rotatably mounted in the inner bottom of the washing tub 2. The pulsator-type washing machine is equipped with an electric motor 4, a speed-reducing gear assembly 5, and a pulley belt 8. The electric motor 4 is driven to be rotated at a certain rotational speed to thereby generate a rotational force. The rotational speed is transmitted to the speed-reducing gear assembly 5 through the pulley belt 8. The pulsator 3 is fixedly mounted on the speed-reducing gear assembly 5. Accordingly, the activation of the electric motor 4 causes the pulsator 3 to be rotated. The speed-reducing gear assembly 5 reduces the rotational speed of the electric motor 4. With the reduced rotational speed of the speed-reducing gear assembly 5 used, a washing step, a rinsing step, and a dehydrating step for the laundry proceeds either in a selective manner or in a sequential manner. The waterflow caused by the rotation of the pulsator 3 is a heart-type waterflow. Since the heart-type waterflow is concentric waterflow, laundry in the waterflow becomes twisted and entangled around the center portion of the washing tub 2. The pulsator 3 is formed in a nearly flat plate. Since the pulsator 3 is rotated on the bottom of the washing tub 2 to form a waterflow, a relatively strong waterflow is formed in the vicinity of the pulsator 3 but it becomes weaker upon moving away from the vicinity of the pulsator 3. Therefore, there is a drawback because even though the laundry in the water away from the vicinity is washed, washing efficiency is decreased since the laundry does not directly receive physical striking.

SUMMARY OF THE INVENTION

It is an object of the present invention to provide a washing machine equipped with a laundry-striking apparatus capable of applying a physical striking to laundry.

In order to attain the above object, the present invention includes a cam, a plurality of horizontal movement parts, and a plurality of vertical movement parts.

The cam is fixedly inserted into the shaft of a speed-reducing gear assembly between a pulsator and the speed-reducing gear assembly (or called "gear mechanism"). On the outer circumference of the cam concavities and convexities are alternately formed. Therefore, the cam is rotated in accordance with the rotation of the shaft. The plurality of horizontal movement parts are slidably contacted with the outer circumference to thereby be reciprocated in left and right directions according to the concavities and convexities. The plurality of vertical movement parts are connected to the plurality of horizontal movement parts respectively. Each of the plurality of vertical movement parts moves up and down in the vertical direction according to the left and right reciprocal movements of each of the plurality of horizontal movement parts. The plurality of horizontal movement parts are movably mounted on the inner bottom of the washing tub. Each of the plurality of horizontal movement parts includes a following member which is slidably contacted on the outer circumference of the cam and an elastic part which elastically supports the following member. The elastic part has an elastic spring. The plurality of vertical movement parts are hingedly connected to the plurality of horizontal movement parts respectively, inserted to be mounted from the outer bottom to the inside of the washing tub. Each of the plurality of vertical movement parts includes a linkbar assembly which moves up and down in the vertical direction by being folded and unfolded in accordance with the left and right horizontal movements of its corresponding horizontal movement part and a striking member which is engaged with the upper portion of the linkbar assembly and moves in the vertical direction according to the vertical direction of the linkbar assembly. The linkbar assembly includes a plurality of unit linkbar assemblies each formed in a rotatably hinged connection at the intersected portion of two linkbars. The lowermost unit linkbar assembly is rotatably connected to the following member. The striking member is formed in a sphere or a hemisphere shape. Each of the plurality of vertical movement parts is covered with an elastic shield. The elastic shield is fabricated with elastic thread and formed in a net shape.

The moving up and down in the vertical direction of the plurality of vertical movement parts causes the striking member to move up and down to thereby directly strike laundry in the washing tub. The elastic shield prevents articles of laundry from being inserted inside each of the plurality of vertical movement parts. The direct striking enhances washing efficiency of laundry.

BRIEF DESCRIPTION OF THE DRAWINGS

These and other objects and features of the present invention can be understood through the following embodiment by reference to the accompanying drawings, in which.

DETAILED DESCRIPTION OF THE PREFERRED EMBODIMENT

An embodiment according to the present invention will be hereinafter described with reference to accompanying drawings.

Figure 1:
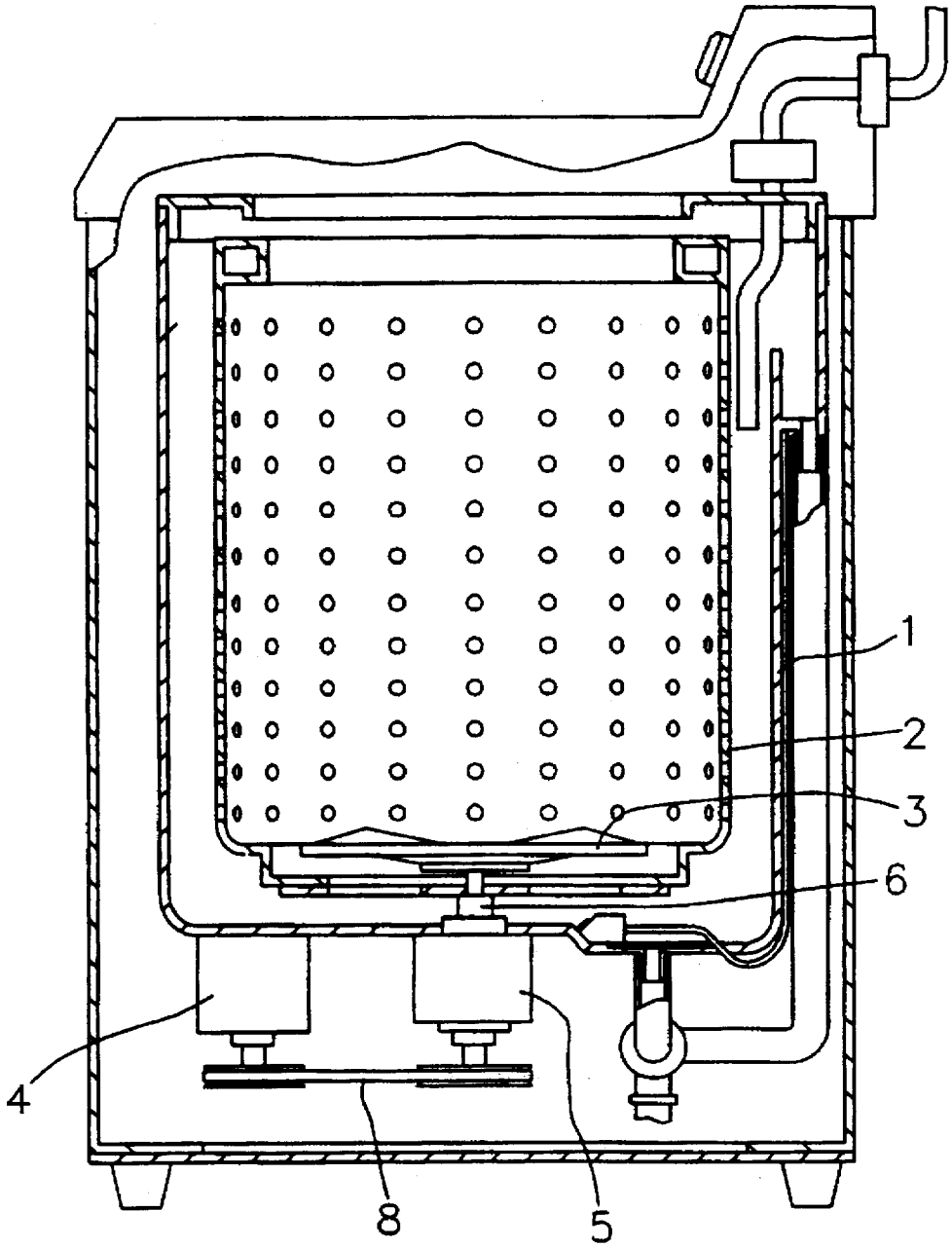
FIG. 1 PRIOR ART
FIG. 1 is a view for schematically showing a conventional pulsator-type washing machine.
Figure 2:
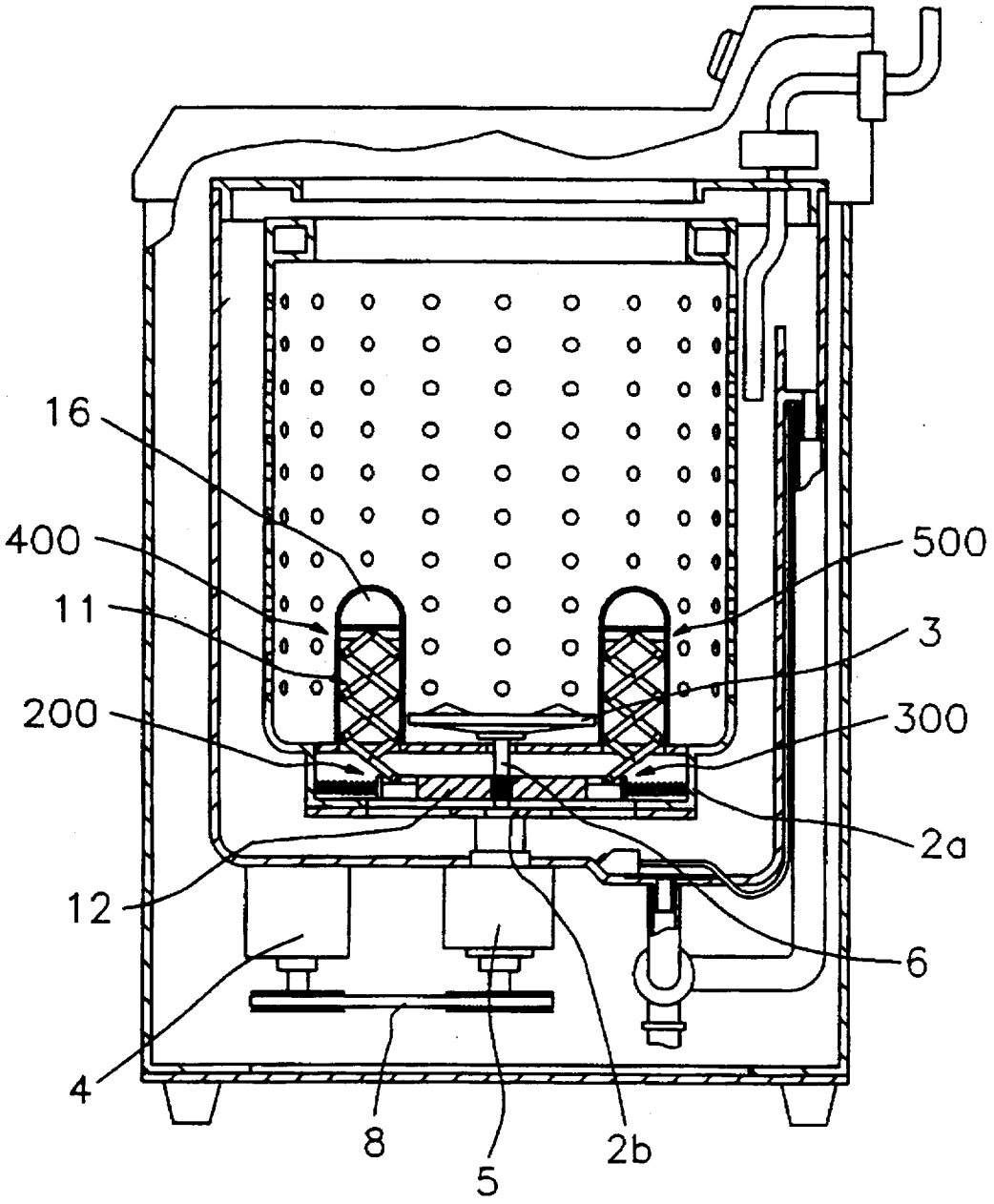
FIG. 2 is a view for schematically showing a washing machine equipped with a laundry-striking apparatus according to an embodiment of the present invention.
Figure 6:
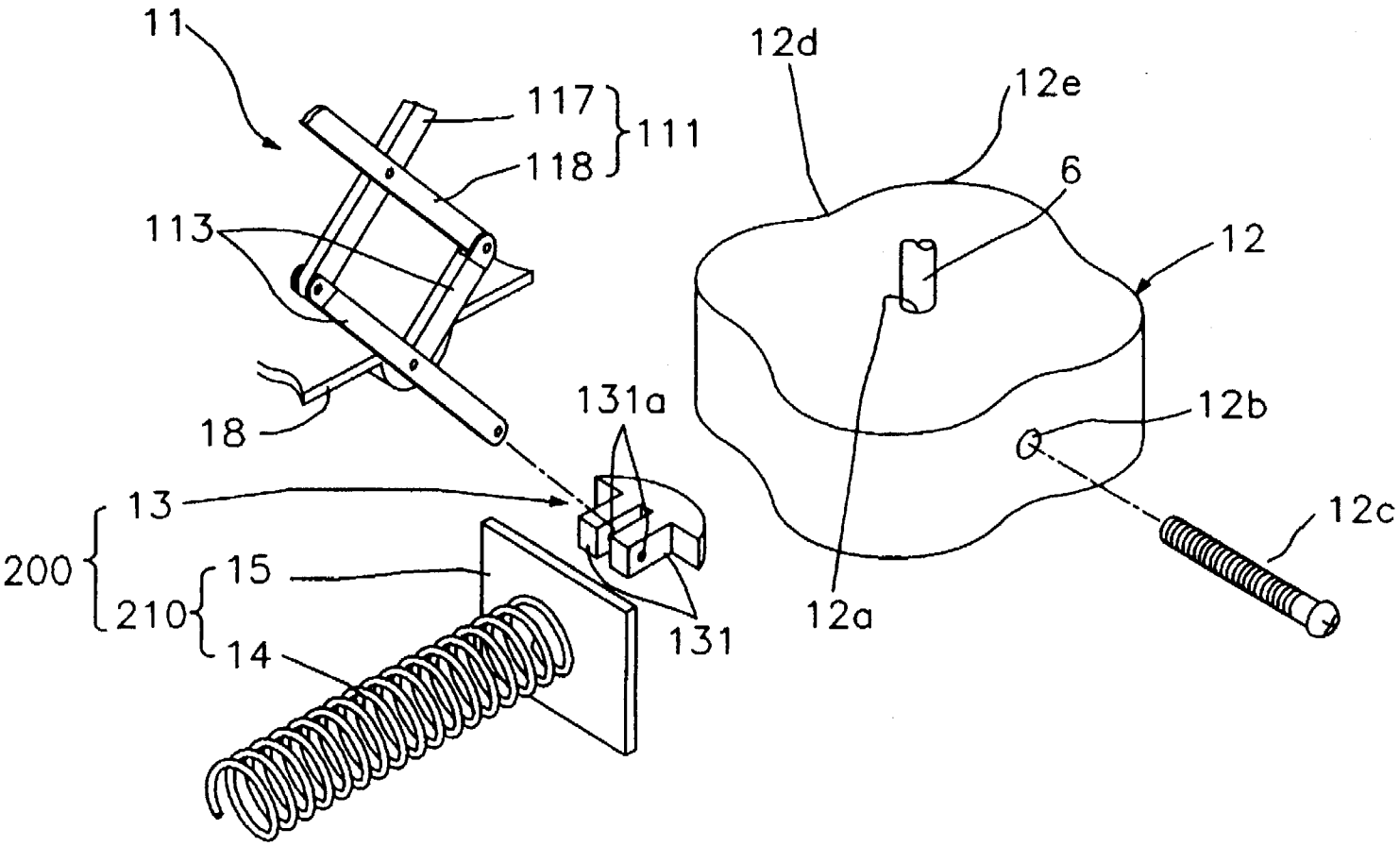
FIG. 6 is a view for schematically and explosively showing a major portion of FIG. 2.

FIG. 2 is a view for schematically showing a washing machine equipped with a laundry-striking apparatus according to an embodiment of the present invention, and FIG. 6 is a view for schematically and explosively showing a major portion of FIG. 2.

As shown in FIG. 2, the washing machine 211 equipped with a laundry-striking apparatus 211*a* includes a pulsator 3, an electric motor 4, a speed-reducing gear assembly 5, a pulley belt 8, a first horizontal movement part 200, a second horizontal movement part 300, a first vertical movement part 400, and a second vertical movement part 500. When electric power is applied to the washing machine externally, the electric motor 4 is rotated at a certain rotational speed. The rotation of the electric motor 4 is transmitted to the speed-reducing gear assembly 5 through the pulley belt 8. The speed-reducing gear assembly 5 has a rotational shaft 6. The speed-reducing gear assembly 5 reduces the rotational speed of the electric motor 4. The rotational shaft 6 is rotated at the reduced rotational speed. The pulsator 3 is fixed at one end of the rotational shaft 6 so as to be rotated according to the rotation of the rotational shaft 6. As shown in FIG. 6, the outer circumference of the cam 12 has concavities 12d and convexities 12*e* which are alternately formed thereon. Together with the pulsator 3, the cam 12 is rotated according to the rotation of the rotational shaft 6. The first horizontal movement part 200 and the second horizontal movement part 300 are mounted to make contact with the outer circumference of the cam 12. The first horizontal movement part 200 and the second horizontal movement part 300 horizontally move in the left and right directions according to the rotation of the cam 12. The first vertical movement part 400 and the second vertical movement part 500 are hingedly connected to the first horizontal movement part 200 and the second horizontal movement part 300, respectively. When the first horizontal movement part 200 and the second horizontal movement part 300 are respectively reciprocated in the left and right directions, the first vertical movement part 400 and the second vertical movement part 500 are respectively reciprocated in the up and down directions. The arrows shown in FIGS. 3 and 4 indicate the horizontal and vertical reciprocating movement directions.

Referring back to FIGS. 2 and 6, the washing tub 2 has an accommodation portion 2*a* on the lower portion thereof in order for the cam 12, the first horizontal movement part 200, and the second horizontal movement part 300 to be accommodated therein. The rotation shaft 6 of the speed-reducing gear assembly 5 is inserted into an opening 2*b* formed in the bottom center portion of the washing tub 2. The outer bottom surface of the reception portion 2*a* is supported by the speed-reducing gear assembly 5. The center portion of the cam 12 has an insertion hole 12*a*. The rotational shaft 6 is inserted into the cam 12 through the insertion hole 12*a*. The cam 12 has, for example, an engagement hole 12*b*, and the rotational shaft 6 has an engagement groove (not shown). A screw bolt 12*c* is inserted from the insertion hole 12*a* up to the engagement groove so that the cam 12 and the rotational shaft 6 are fixed together.

FIG. 6 is a view for schematically and explosively showing a major portion of the first horizontal movement part 200 of FIG. 2. The second horizontal movement part 300 has the same structure and operation that the first horizontal movement part 200 has, so that explanation of the second horizontal movement part 300 will be omitted. As shown in FIG. 6, the first horizontal movement part 200 includes a following member 13 and an elastic part 210. The elastic part 210 has a spring plate 15 and a spring 14. One side of the following member 13 is machined to be formed in a rounded shape, and the other side has two protrusions 131 each of which has a hinge hole 131a. The rounded side is mounted to be slidably contacted on the outer circumference of the cam 12. The front side of the spring plate 15 faces the protrusions 131 of the following member 13 to be supported thereby. One end of the spring 14 is fixed to the back side of the spring plate 15, and the other end of the spring 14 is fixed to the accommodation portion 2*a*. The spring 14 provides elasticity for the spring plate 15 and the following member 13. Therefore, when the cam 12 is rotated, the following member 13 rectilinearly moves in the left and right directions by the concavities 12*d* and convexities 12*e* of the cam 12.

Figure 3:
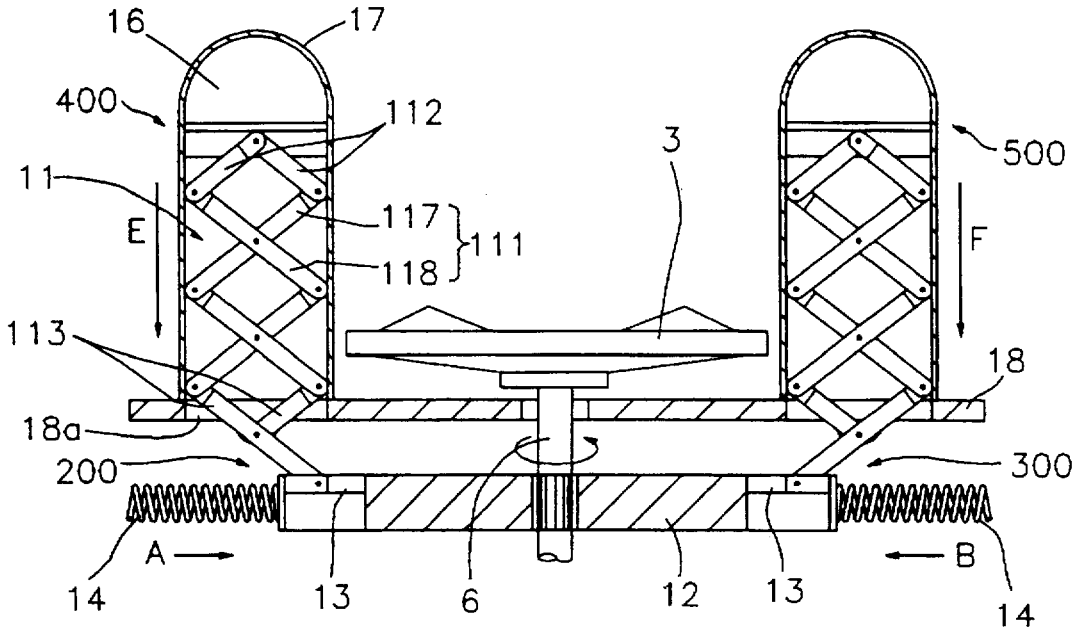
FIGS. 3 and 4 are views for explaining operations of the laundry-striking apparatus of FIG. 2.
Figure 5:
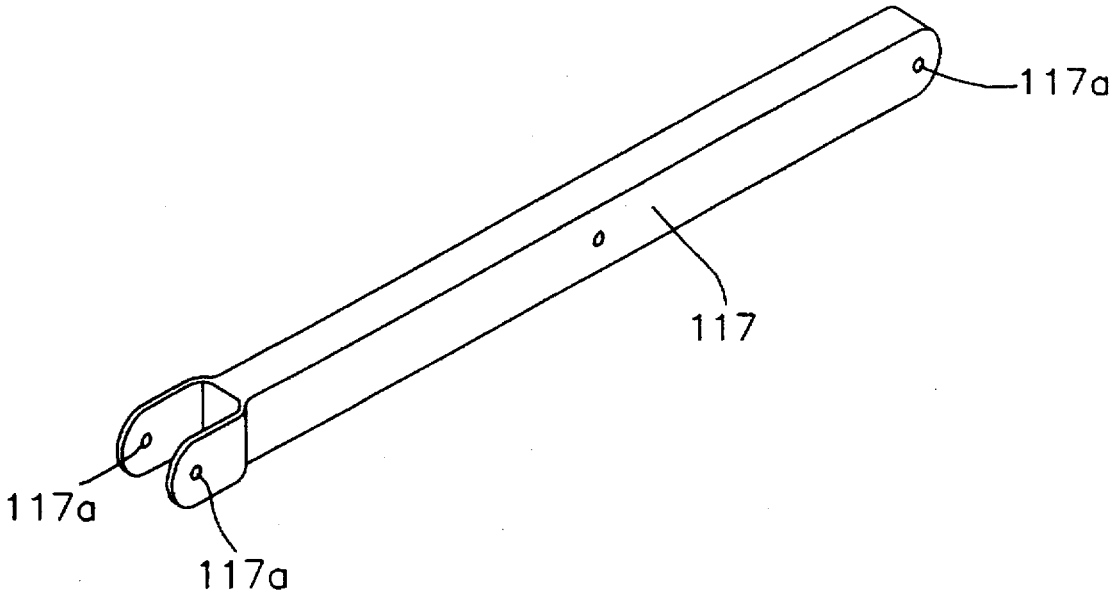
FIG. 5 is a view for showing a linkbar constituting a unit linkbar assembly of FIG. 3.

Referring back to FIGS. 3 and 6, the first vertical movement part 400 is engaged with the first horizontal movement part 200. Such engagement is applied to the engagement of the second vertical movement part 500 and the second horizontal movement part 300. The first vertical movement part 400 includes a linkbar assembly 11 and a striking member 16. The linkbar assembly 11 is hingedly connected to the first horizontal movement part 400, so that the linkbar assembly 11 moves up and down in the vertical direction when the first horizontal movement part 200 rectilinearly moves in the left and right directions. The linkbar assembly 11 is formed with a plurality of unit linkbar assemblies. A unit linkbar assembly 111 is structured with two linkbars 117 and 118 crossed to each other, for example. The center portions of the linkbars 117 and 118 are crossed in an X-shaped manner in order for the linkbars 117 and 118 to be rotatably connected. FIG. 5 is a view for showing a linkbar constituting a unit linkbar assembly of FIG. 3. As shown in FIG. 5, end portions of the linkbar 117 respectively have hinge holes 117*a*. The plurality of unit linkbar assemblies are connected to each other through the hinge holes 117*a*. That is, each end of the linkbars of one unit linkbar assembly is rotatably linked through hinge holes with each end of the linkbars of another unit linkbar assembly. The link of the plurality of unit linkbar assemblies is shown in FIG. 3. Accordingly, operations of one unit linkbar assembly brings operations of another unit linkbar assembly. As shown in FIG. 3, a unit linkbar assembly combined at the uppermost portion of the linkbar assembly 11 is denoted as an uppermost unit linkbar assembly 112, and a unit linkbar assembly combined at the lowermost portion of the linkbar assembly 11 is denoted as a lowermost unit linkbar assembly 113. Referring to FIG. 6, one linkbar of the lowermost unit linkbar assembly 113 is inserted between the protrusions 131 so as to be rotatably linked with the protrusions 131. Further, the cross center of the two linkbars of the lowermost unit linkbar assembly 113 is hingedly fixed to the bottom of the washing tub 2. The linkbar assembly 11 is inserted into insertion holes 18*a* in order for the linkbar assembly 11 to be mounted in the washing tub 2. The cross center of the two linkbars of the uppermost unit linkbar assembly 112 is hingedly engaged with the bottom center of the striking member 16. The striking member 16 may be made of plastics. The striking member 16 may be formed in a sphere or a hemisphere shape. The shape of the striking member 16 is designed only to apply physical impulses to laundry in washing water, not to result in mechanical or physical damages to the laundry.

Further, the linkbar assembly 11 is covered with an elastic shield 17. The elastic shield 17 is fabricated with elastic thread and formed in a net shape. Therefore, the elastic shield 17 expands and contracts according to the up and down movements of the linkbar assembly 11. The elastic shield 17 prevents articles of laundry from being inserted in the plurality of unit linkbar assemblies which move up and down, so that the articles of laundry are protected from possible damage to laundry which can be caused by the up and down movements of the plurality of unit linkbar assemblies.

Hereinafter, operations of the laundry-striking apparatus according to the present invention will be described.

Figure 4:
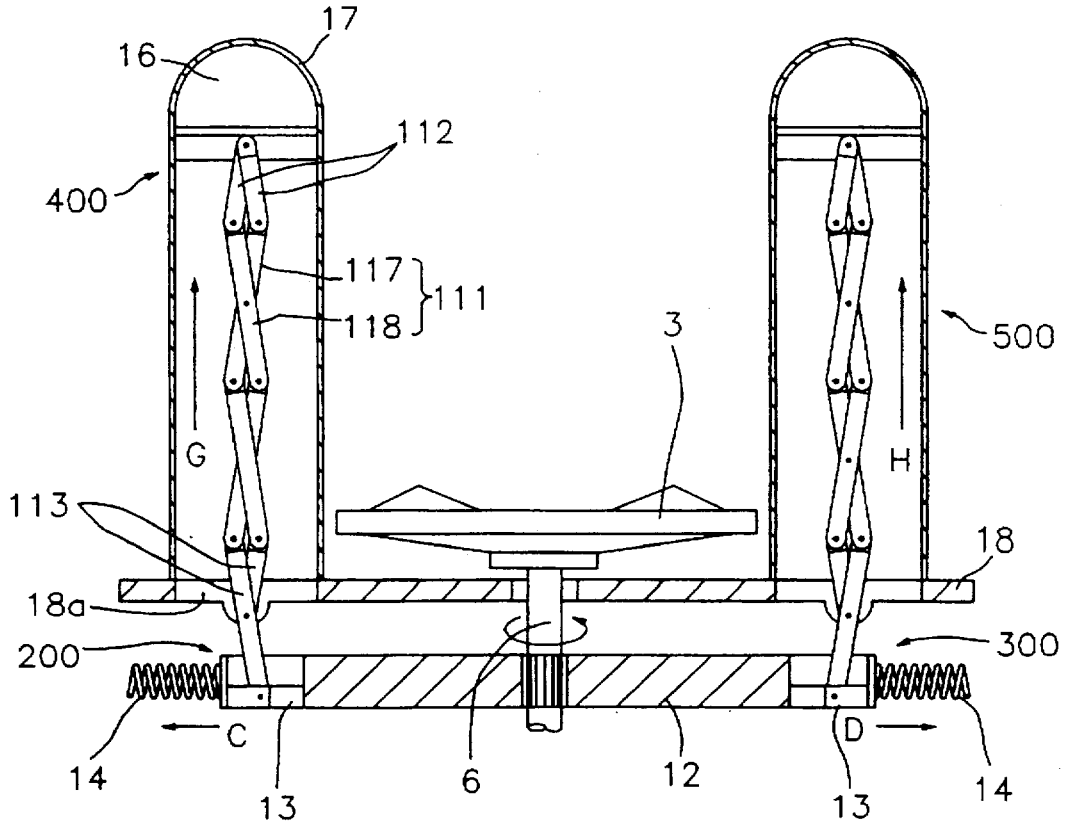

FIGS. 3 and 4 are views for explaining operations of the laundry-striking apparatus of FIG. 2. As shown in FIGS. 3 and 4, the electric motor 4 is driven to be rotated at a certain rotational speed to thereby generate a rotational force. The rotational speed is transmitted to the speed-reducing gear assembly 5 through the pulley belt 8. The pulsator 3 is fixedly mounted on the speed-reducing gear assembly 5. Accordingly, the activation of the electric motor 4 causes the pulsator 3 to be rotated. The speed-reducing gear assembly 5 reduces the rotational speed of the electric motor 4. Therefore, the rotational shaft 6 is rotated at the reduced speed. The rotation of the rotational shaft 6 causes the pulsator 3 and the cam 12 to be rotated. The rotation of the pulsator 3 rotates washing water in the washing tub 2. Laundry is rotated in the washing water according to the rotation of the washing water. With the rotation of the cam 12, the following member 13 alternately contacts the concavities 12*d* and convexities 12*e* of the cam 12. Further, the following member 13 is elastically supported by the spring 14 and the spring plate 15. The alternate contact and the elastic support of the following member 13 causes the first horizontal movement part 200 and the second horizontal movement part 300 to move in the left and right directions in the accommodation portion 2*a* (refer to arrows A, B, C, and D shown in FIGS. 3 and 4). The lowermost unit linkbar assembly 113 repeats folding and unfolding operations according to the leftward and rightward movements of the first horizontal movement part 200 and the second horizontal movement part 300. With the repeated folding and unfolding operations, the other plurality of unit linkbar assemblies which are connected to the lowermost unit linkbar assembly 113, including the uppermost unit linkbar assembly 112, repeat folding and unfolding operations. Accordingly, the first vertical movement part 400 and the second vertical movement part 500 each perform vertical movements in the up and down directions (refer to the arrows E, F, G, and H shown in FIGS. 3 and 4). Accordingly, the striking members 16 each connected to the first vertical movement part 400 and to the second vertical movement part 500 apply direct impulses to the articles of the laundry. The direct striking impulses enhances the washing effect upon the laundry.

It is understood that various other modifications will be apparent to and can be readily made by those skilled in the art without departing from the scope and spirit of this invention. Accordingly, it is not intended that the scope of the claims appended thereto be limited to the descriptions set forth herein, but rather that the claims be constructed as encompassing all the features of the patentable novelty that reside in the present invention, including all the features that would be treated as equivalents thereof by those skilled in the art to which this pertains.

What is claimed is:

1. A washing machine having a washing tub for accommodating laundry, a pulsator mounted in the washing tub, an electric motor for rotating the pulsator, and a speed-reducing gear assembly with a shaft connected to the pulsator and for controlling a rotation speed of the electric motor so as to rotate the shaft, comprising:

a cam to which the shaft is fixedly inserted, the cam being rotated according to the rotation of the shaft, the cam being formed with concavities and convexities alternately on an outer circumference thereof;

a plurality of horizontal movement parts slidably contacted with the outer circumference to thereby be reciprocated in a horizontal direction by the concavities and the convexities when the cam is rotated; and a plurality of vertical movement parts being installed in the washing tub, the vertical movement parts being connected to the horizontal movement parts respectively, the vertical movement parts being reciprocated in a vertical direction in the washing tub by a reciprocating movement of the horizontal movement parts respectively.

2. The washing machine as claimed in claim 1, wherein each of the horizontal movement parts includes:

a following member being in contact with the outer circumference of the cam; and an elastic part for elastically supporting the following member.

3. The washing machine as claimed in claim 2, wherein the elastic part includes an elastic spring.

4. The washing machine as claimed in claim 2, wherein each of the vertical movement parts includes:

a linkbar assembly comprising a plurality of unit linkbar assemblies consisting of a pair of linkbars which are pivotably linked with each other at central part thereof, wherein one end of each linkbar in one unit linkbar assembly is hingedly linked with one end of each linkbar in other unit linkbar assembly so that the unit linkbar assemblies are hingedly linked with each other, and one of a lowermost linkbar is hingedly connected to the following member, whereby the reciprocating movement of the following member in the horizontal direction is changed into the reciprocating movement of the linkbar assembly in the vertical direction by a pivoting movement of the lowermost linkbar connected with the following member and pivoting movements of the other linkbars thereby; and a striking member engaged with an upper portion of the linkbar assembly and moving in the vertical direction according to the reciprocating movement of the linkbar assembly.

5. The washing machine as claimed in claim 4, wherein the striking member is formed in a hemisphere shape.

6. The washing machine as claimed in claim 4, wherein the linkbar assembly is covered with an elastic shield.

* * * * *